US006779965B2

(12) United States Patent
Pessin et al.

(10) Patent No.: US 6,779,965 B2
(45) Date of Patent: Aug. 24, 2004

(54) INTEGRATED AXIAL FLOW PUMP

(75) Inventors: Jean-Louis Pessin, Houston, TX (US); Edward Leugemors, Sugar Land, TX (US); Sylvain Bedouet, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 21 days.

(21) Appl. No.: 10/231,497

(22) Filed: Aug. 30, 2002

(65) Prior Publication Data

US 2003/0202875 A1 Oct. 30, 2003

Related U.S. Application Data

(60) Provisional application No. 60/375,632, filed on Apr. 26, 2002.

(51) Int. Cl.[7] ..... F04D 29/06

(52) U.S. Cl. ..... 415/1; 415/111; 415/112; 415/116; 415/175; 415/180; 184/31

(58) Field of Search ..... 415/58.5, 111, 415/112, 116, 216.1, 1, 175, 180; 184/26, 31

(56) References Cited

U.S. PATENT DOCUMENTS

| | | | | | |
|---|---|---|---|---|---|
| 2,003,168 | A | * | 5/1935 | Allen | 415/198.1 |
| 2,350,448 | A | * | 6/1944 | Collins | 366/155.1 |
| 2,632,395 | A | * | 3/1953 | Jennings et al. | 415/112 |
| 2,684,034 | A | * | 7/1954 | Roth | 415/115 |
| 3,213,798 | A | * | 10/1965 | Carswell | 415/175 |
| 3,489,419 | A | * | 1/1970 | Stratienko | 277/408 |
| 3,659,862 | A | * | 5/1972 | Sebestian | 277/523 |

* cited by examiner

*Primary Examiner*—Ninh H. Nguyen

(57) ABSTRACT

An apparatus is given for feeding a lubricating and cooling material to a pump or other device having a rotating member that operates intermittently. In particular it deals with methods for delivering lubricant to the pump whenever, and only whenever, the pump is running and with ensuring that the pump is always adequately lubricated when it is running. It is particularly useful for centrifugal pumps on mobile equipment, such as pumps used in cementing in the oil industry.

5 Claims, 8 Drawing Sheets

INTEGRATED AXIAL FLOW PUMP

This application claims the benefit of Provisional Application No. 60/375,632 filed Apr. 26, 2002.

TECHNICAL FIELD OF THE INVENTION

The present invention relates to cooling and lubricating the rotating shaft of a device, such as a centrifugal pump, which operates intermittently and which requires introduction of the lubricant and coolant only when the shaft is turning. In particular it relates to providing a simple cooling and lubricating system that is independent of the rest of the unit in which the centrifugal pump is incorporated. Most particularly it relates to the use of such devices on mobile units used in the oilfield.

BACKGROUND OF THE INVENTION

In the case of a centrifugal pump stuffing box, oil must be supplied to the stuffing box for lubrication of seals and for cooling. In a classical solution for oil supply, a schematic of which is shown in FIG. 1 (prior art), a centrifugal pump [10], has a fluid suction line [12], a fluid discharge line [14], a stuffing box [16] containing a seal or seals (not shown), and a rotating shaft [18] driven by a motor [20]. The lubricating and cooling oil is provided from an external reservoir [22] to an external oil pump [24] that forces the oil into the stuffing box. It is necessary to have a shaft rotation detection device [26] so that lubricating/cooling oil can be provided from the external oil pump only when the shaft of the centrifugal pump is rotating. This device sends a signal to a controller [28] for the external oil pump so that the pump operates only when the shaft is turning. Otherwise, oil will be wasted, and undesirable contamination of the area around the centrifugal pump can occur, if oil is provided past a leaking seal, especially when the pump is not operating.

For common oilfield cement pumping equipment, the lubricant supply system of, for example, a typical centrifugal pump having a 6 inch nominal internal diameter inlet and a 5 inch nominal internal diameter outlet does not use an external oil pump as in the classical system shown in FIG. 1. Instead, as shown schematically in FIG. 2 (prior art), air pressure from an air compressor [30] forces oil from a supply vessel, such as an air-over-oil tank [32], into the stuffing box. As in the classical case, this air over oil lubricant/coolant supply system requires an external oil delivery control triggered by detection of the shaft rotation or engagement to the power source. On the lubricant line [34] that carries lubricant from the tank to the stuffing box, there are two valves. An air-actuated valve [36] completely opens or closes the line as the centrifugal pump power take-off (not shown) is engaged, thus forcing oil to flow into the stuffing box. The metering valve [38], downstream of the air-actuated valve, is set such that the correct amount of oil is delivered to the centrifugal pump when the pump is running. The metering valve is typically a needle valve but may be any suitable valve.

There are a number of problems with this system. The oil must be provided under pressure in this system, so an external compressor or pump is needed. The system requires control valves and metering valves that can fail, malfunction, or clog, so it cannot ensure that oil will be delivered when the shaft is turning. Also, it is complicated and is dependent upon many devices (such as motors, controls, detectors, monitors, and the like) that are extraneous to the system to be lubricated. If any of these components were to fail, lubrication/cooling would cease.

There is a need for a method in which the oil does not need to be provided under pressure, no external compressor or pump is needed, and no control valves or metering valves that can fail, malfunction, or clog are needed. There is a need for a method that ensures that oil will be delivered whenever, and only whenever, the shaft is turning, provided only that the lubricant source contains lubricant. The method should be very simple and independent of any devices (such as motors, controls, detectors, monitors, and the like) that are extraneous to the system to be lubricated.

SUMMARY OF THE INVENTION

A preferred embodiment is an apparatus, having a rotating shaft requiring a lubricating and cooling material to flow along the rotating shaft between the shaft and the seals while the shaft is rotating, that has an integrated axial flow pump that moves the lubricating/cooling material from an external supply vessel into the stuffing box through an inlet between the seals. Apparatus having such rotating shafts include, in particular, centrifugal pumps and vacuum pumps. Embodiments include using an integrated axial flow pump employing a blade or blades that are straight or spiral, or a groove or grooves that are straight or spiral. In another embodiment, the lubricating and cooling material is recirculated. In yet other embodiments, the integrated axial flow pump may be external to the stuffing box and lubricating and cooling material passes from that integrated axial flow pump to an inlet between the seals in the stuffing box through a conduit. In yet another embodiment, the integrated axial flow pump has at least one component integral to the rotating shaft and at least one component integral to the stuffing box. Other embodiments include methods of cooling and lubricating rotating shafts. Further embodiments include methods of pumping cement into a wellbore penetrating a subterranean formation with a pump cooled and lubricated with an integrated axial flow pump. The common feature is that the cooling and lubricating material is delivered to the appropriate sealing point on the rotating shaft whenever, and only whenever, the shaft is turning.

DETAILED DESCRIPTION OF PREFERRED EMBODIMENTS

Figure 1:
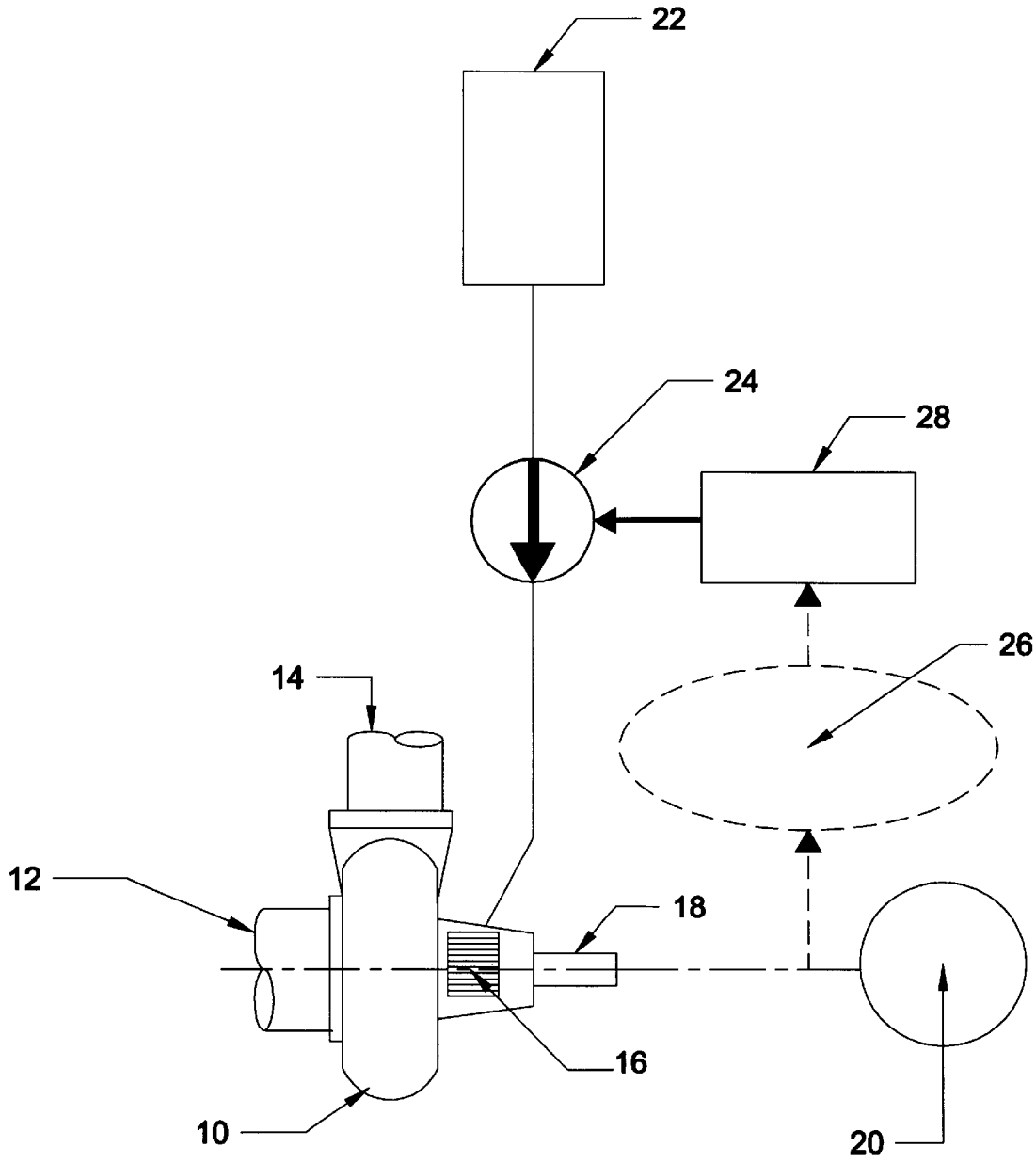
(PRIOR ART) FIG.1
FIG. 1 is a schematic of a prior art method of supplying lubricant to the stuffing box of a pump.
Figure 2:
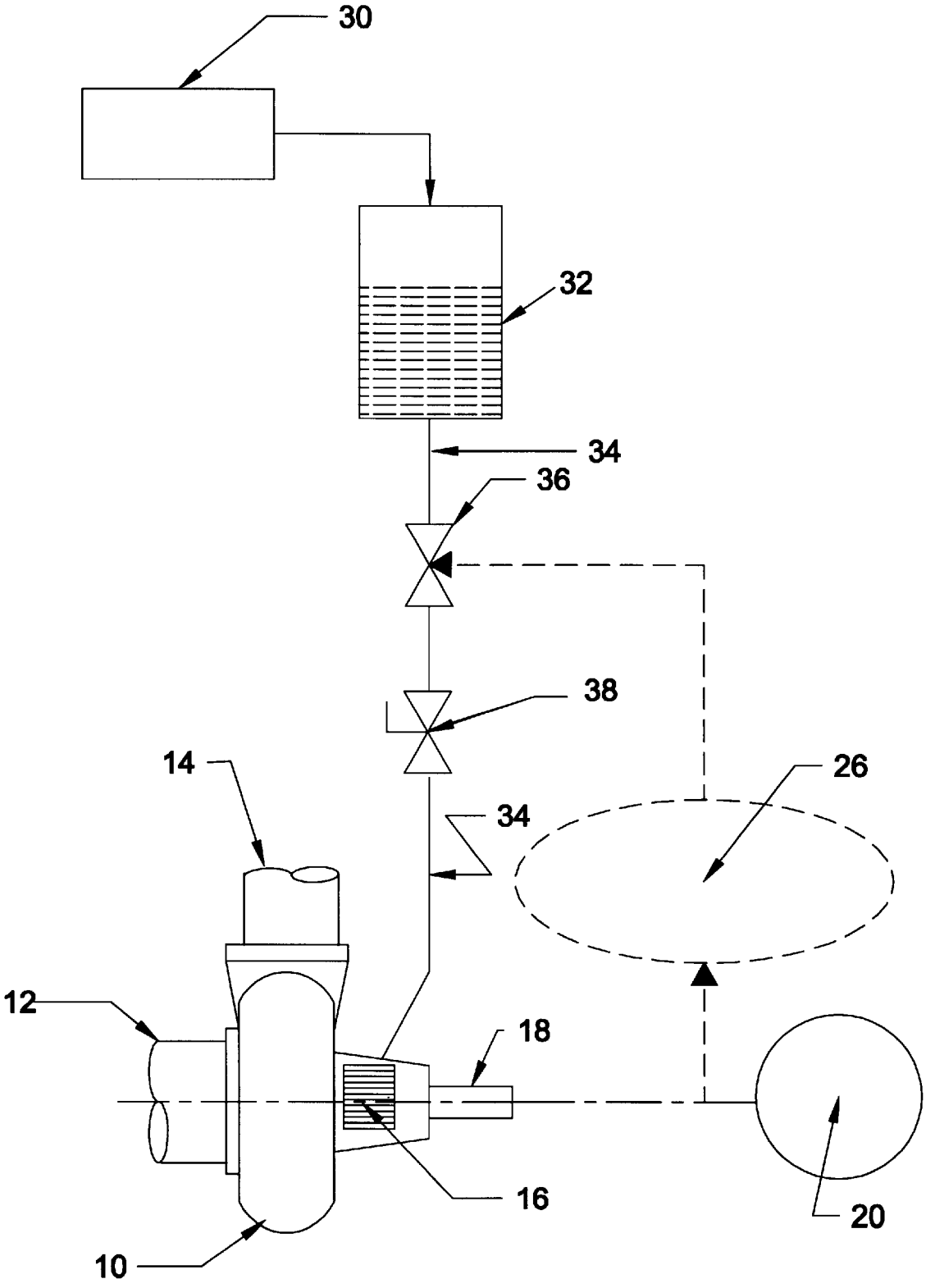
(PRIOR ART) FIG.2
FIG. 2 is a schematic of a prior art method of lubricating a centrifugal pump on a cementing truck.
Figure 3:
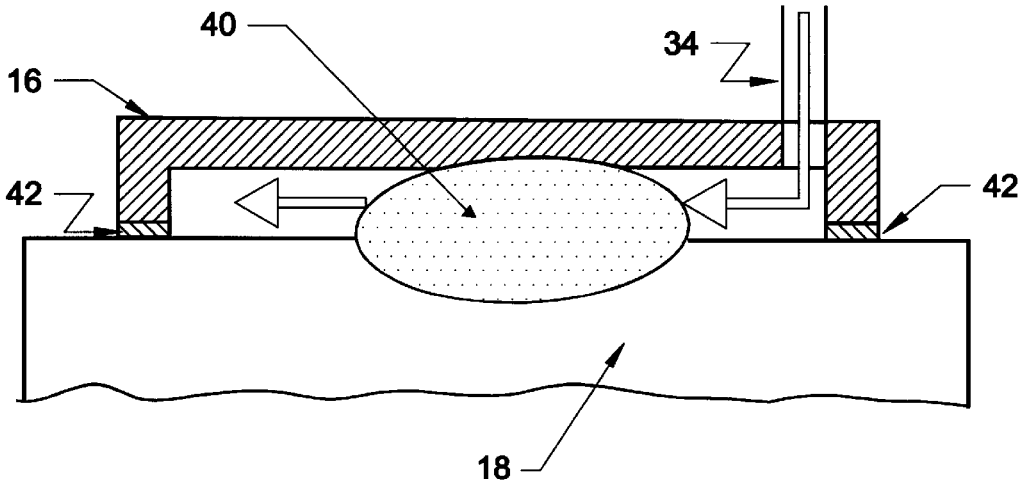
FIG. 3 is a schematic of an integrated axial flow pump located in the stuffing box of a pump.

A generic schematic of the lubricated stuffing box region of a system employing an integrated axial flow pump is shown in FIG. 3. The integrated axial flow pump [40] is a pumping device included in the system to be lubricated. It is called "integrated" because it essentially is part of or mounted on the rotating shaft [18] and it uses the motive force of the rotating shaft to pump lubricant fluid through the system from the external line [34] as shown in FIG. 3. It is called "axial" because it causes the flow of lubricant along the rotating shaft in the direction of the axis of the shaft. (The direction of oil flow is shown in FIG. 3 by the large unfilled arrows.) It delivers lubricant only when the shaft is rotating. Since the system to be lubricated can also be a pump, the key component of the invention will always be termed an "integrated axial flow pump" to distinguish it from a pump being lubricated/cooled. Packing and seals [42] such as but not limited to elastomeric rotating shaft seals contain the lubricant within the stuffing box [16].

Figure 4:
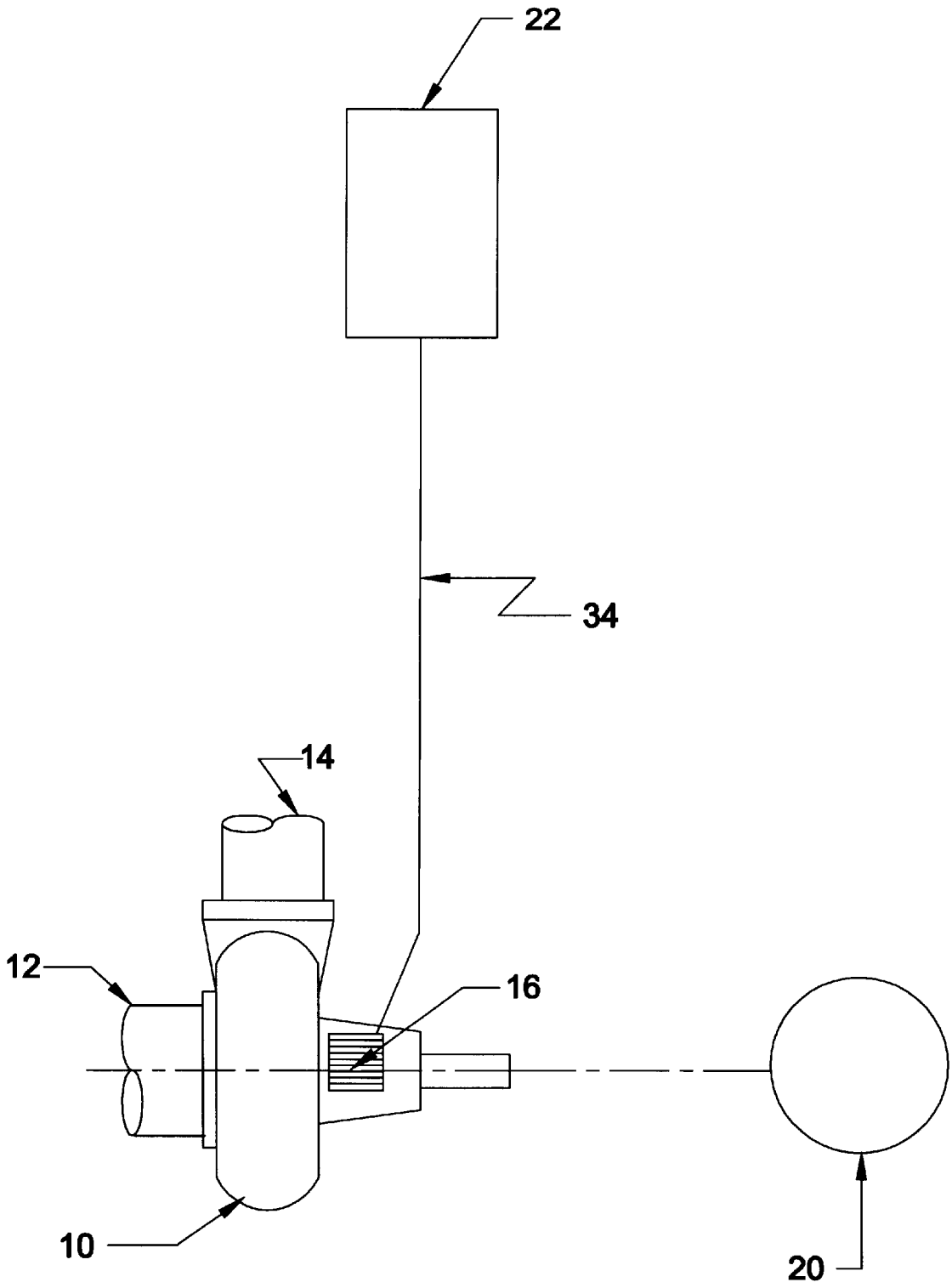
FIG. 4 is a schematic of the use of an integrated axial flow pump to supply lubricant to the stuffing box of a pump.

A general schematic of typical operation of a centrifugal pump lubricated and cooled by oil provided by an integrated axial flow pump is shown in FIG. 4. It is significantly simpler than methods used in previous designs. Although the system is described here for a centrifugal pump mounted on a truck that is used to pump cement, the apparatus and method may be used for any rotating device that requires lubrication whenever, and only whenever, the shaft is turning. Thus the apparatus and method are suitable for a vacuum pump, for example, and for stationary as well as mobile units. The apparatus and method are most suitable for situations in which the greater risk of failure is in the failure of delivery of the lubricant, rather than in the failure of a seal or seals. Although spillage and waste are to be avoided, the greater potential problem for the proper operation of the equipment would be if there were too little lubricant rather than too much; the most important factor is to ensure that lubricant is delivered to the rotating shaft when the shaft is rotating. Although the fluid to be pumped by the integrated axial flow pump is often described here as a lubricant, it is to be understood that it normally has a cooling function as well.

In the system shown in FIG. 4, the external oil pump, the rotation detection device, the controller, the air-actuated valve, and the metering valve are no longer necessary and are not included. Lubricating/cooling oil is drawn directly from the external reservoir [22] through the lubricant line [34] and into the stuffing box [16] that contains the integrated axial flow pump.

This system has a number of important advantages over the two systems most common in current use (an external compressor or an external pump). The lubrication system is completely independent of the rest of the unit and does not depend upon a separate motor or engine. The lubrication system, including the oil inlet, does not need to be pressurized above the ambient pressure of the rotating shaft. The number of necessary parts external to the centrifugal pump is reduced. There is no need for a device for detection of the shaft rotation. There are no settings to monitor and control, such as the metering valve opening or the air tank pressure. Oil delivery metering is achieved by sizing the integrated axial flow pump in accordance with the requirements of the system being lubricated and/or cooled. There are no valves to maintain and no valves that can plug. It is possible to use a closed circuit in which the lubricating oil is recirculated back to the tank.

Figure 5:
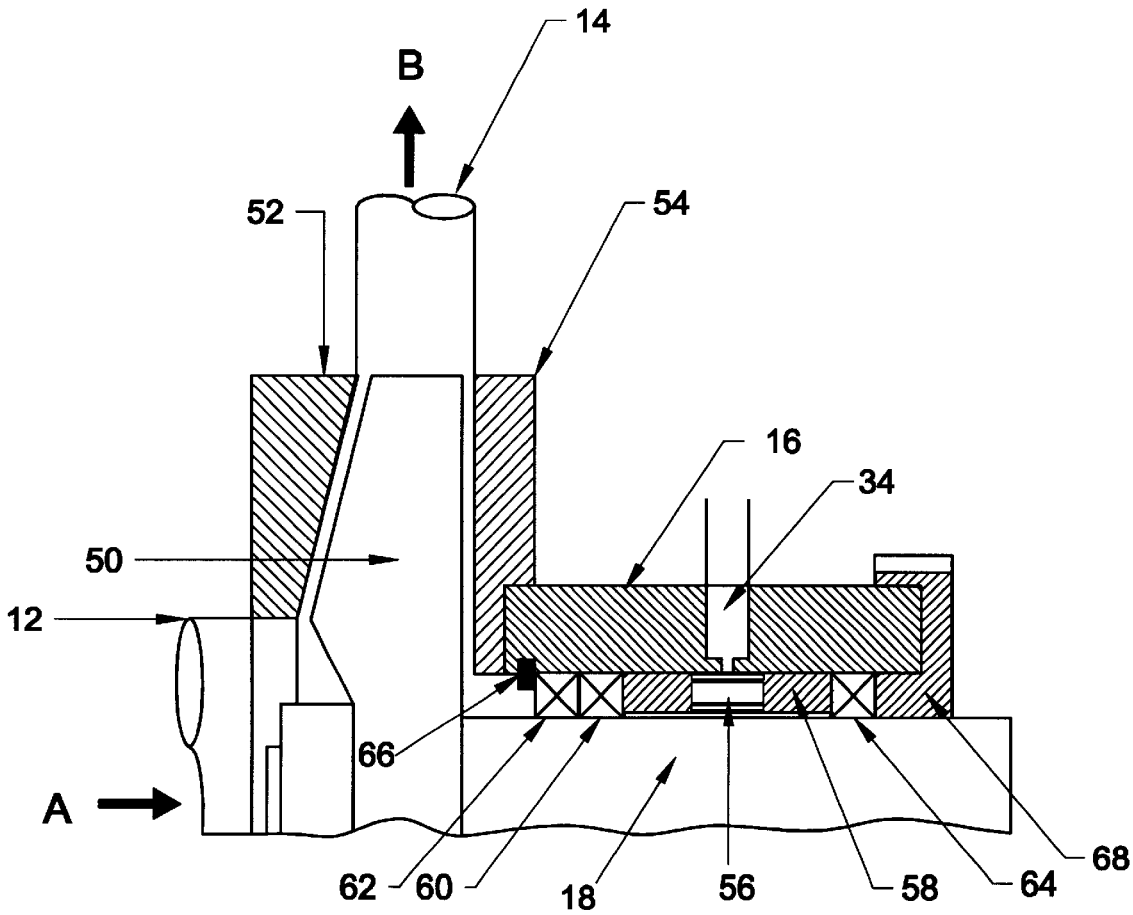
(PRIOR ART) FIG.5
FIG. 5 is a schematic of a prior art stuffing box and pump.

A more detailed explanation of the integrated system follows. Continuing to describe the methods and apparatus according to the centrifugal pump example, FIG. 5 shows a traditional (prior art) stuffing box with packing to isolate the pumped material (lubricating and cooling oil) from the outside environment. The fluid being pumped flows from the fluid suction line [12] in the direction of solid arrow [A] and is moved by the impeller [50] between the front wear plate [52] and the back wear plate [54] and out the fluid discharge line [14] in the direction shown by the solid arrow [B]. The shaft [18] is encased in a stuffing box [16] through which the oil inlet [34] passes into a lantern gland [56] that distributes the oil evenly around the shaft. The lantern gland is held in place by a spacer [58]. The oil is sealed in place by packing or sealing rings [60], [62] and [64] that are held in place on one side by a stop [66], in this case a snap ring, although it may also be held by a shoulder machined into the stuffing box or by other means. The seal or seals are held in place on the other side by a cap or packing retainer [68]. The design of the lantern gland and the number and design of the spacer or spacers, and of the packing or sealing rings and stop or stops are adapted to the specific designs of the stuffing box. If oil is provided at too high a pressure, this system might leak. If oil is not provided, this system might fail due to inadequate lubrication and/or inadequate cooling.

Figure 6:
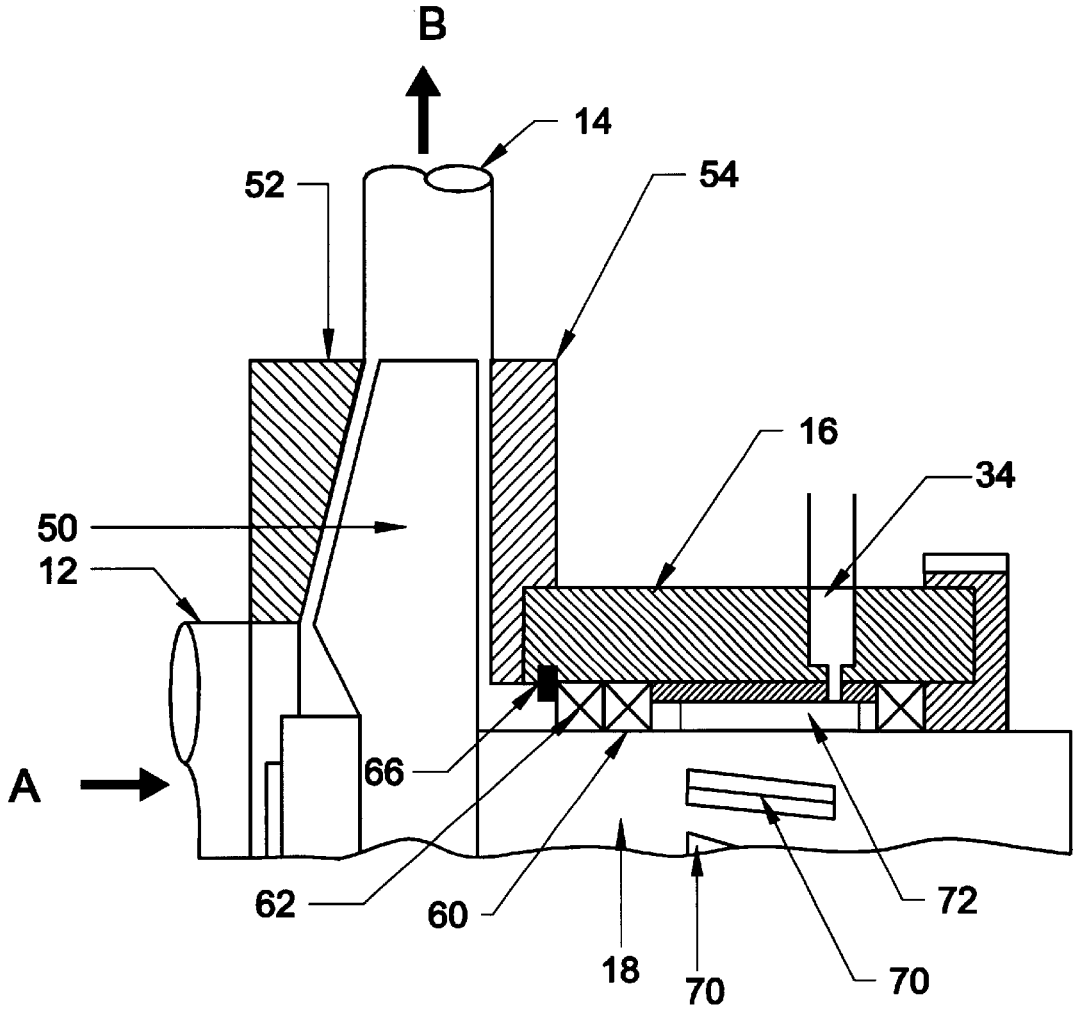
FIG. 6 is a schematic of a pump lubricated with an integrated axial flow pump.

FIG. 6 shows the same system as FIG. 5, but with an integrated axial flow pump consisting of multiple blades [70] mounted on the shaft [18] at an angle, and a lantern gland [72] adapted for this particular form of integrated axial flow pump. The number, size, and angle of the blades are adapted to accommodate the amount of oil and the rate at which it is to be pumped. The design of the lantern gland and the number and design of the spacer or spacers, and of the packing or sealing rings and stop or stops again are adapted to the specific designs of the stuffing box and of the specific integrated axial flow pump used. This is a schematic only, and one skilled in the art could construct many different designs that vary in detail without deviating from the scope and intent of the Invention. For example, the lubricant line may be located so that oil is drawn into the lantern gland at other points, and the blades may be oriented so that the oil is impelled in the opposite direction. As another example, rather than blades, the integrated axial flow pump may also comprise grooves in the shaft forming a partial or complete helical pattern or patterns, with the lantern gland being adjusted to the shaft diameter and providing appropriate routes for oil supply or circulation.

The integrated axial flow pump may take many forms. Using for example an axial flow pump principle with external blades mounted on the shaft, the blades may be spiral or straight, and there may be a single blade or multiple blades. If straight, the blades are at an angle to the axis of the shaft as shown in FIG. 6. Other types of integrated axial flow pumps that may be used include, by non-limiting example, progressive cavity pumps, vane pumps, recirculating ball screws (that may be used as combination pumps and bearings using oil), centrifugal pumps, and peristaltic pumps. Other axial flow pumps known to those skilled in the art may be made integral to the apparatus in many ways known to those skilled in the art without exceeding the scope of the invention. The lantern gland and other ancillary components are modified accordingly. The invention described herein does not specify what form the integrated axial flow pumping device should take. Any axial flow pump may be adapted for this use, whether a commercial design or a design created especially for service in the specific pump or other piece of equipment to be lubricated and/or cooled.

Figure 7:
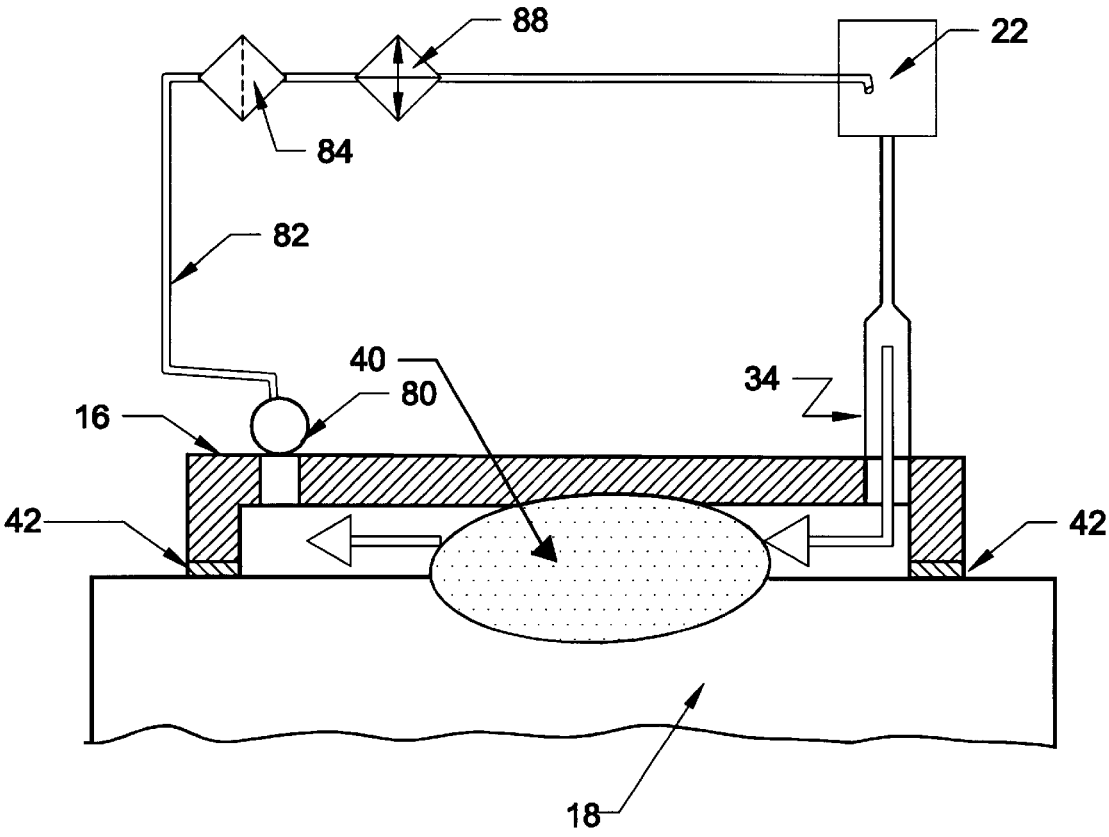
FIG. 7 is a schematic of an integrated axial flow pump, located in the stuffing box of a pump, having a lubricant recirculating system.

In another embodiment, the oil is recirculated, as shown schematically in FIG. 7. Oil is drawn from an external reservoir [22] through an external line into the stuffing box [16] to lubricate and cool the integrated axial flow pump [40]. Oil exits the stuffing box, passes through a relief valve [80], a recirculation line [82] an optional filter [84], and an optional cooler [86] and back into the external reservoir. The filter and cooler, if present, may be located in the recirculation line in the reverse order. The oil may enter and leave the stuffing box at different locations relative to the shaft than those shown. Certain types of integrated axial flow pumps require oil recirculation, such as vane pumps, peristaltic pumps, and gear-in-gear pumps. Others, such as those using blades or grooves on the shaft, do not.

In another embodiment, the integrated axial flow pump is mounted on the rotating shaft in a housing external to the stuffing box, i.e. between the stuffing box and the motor that rotates the shaft. This pump then provides the lubricating and cooling material to the stuffing box from the supply vessel, when the shaft is rotating, through a conduit from the external integrated axial flow pump to the inlet in the stuffing box between the seals. Any of the integrated axial flow pumps described here, or others known to those skilled in the art, may be adapted in this way.

Figure 8:
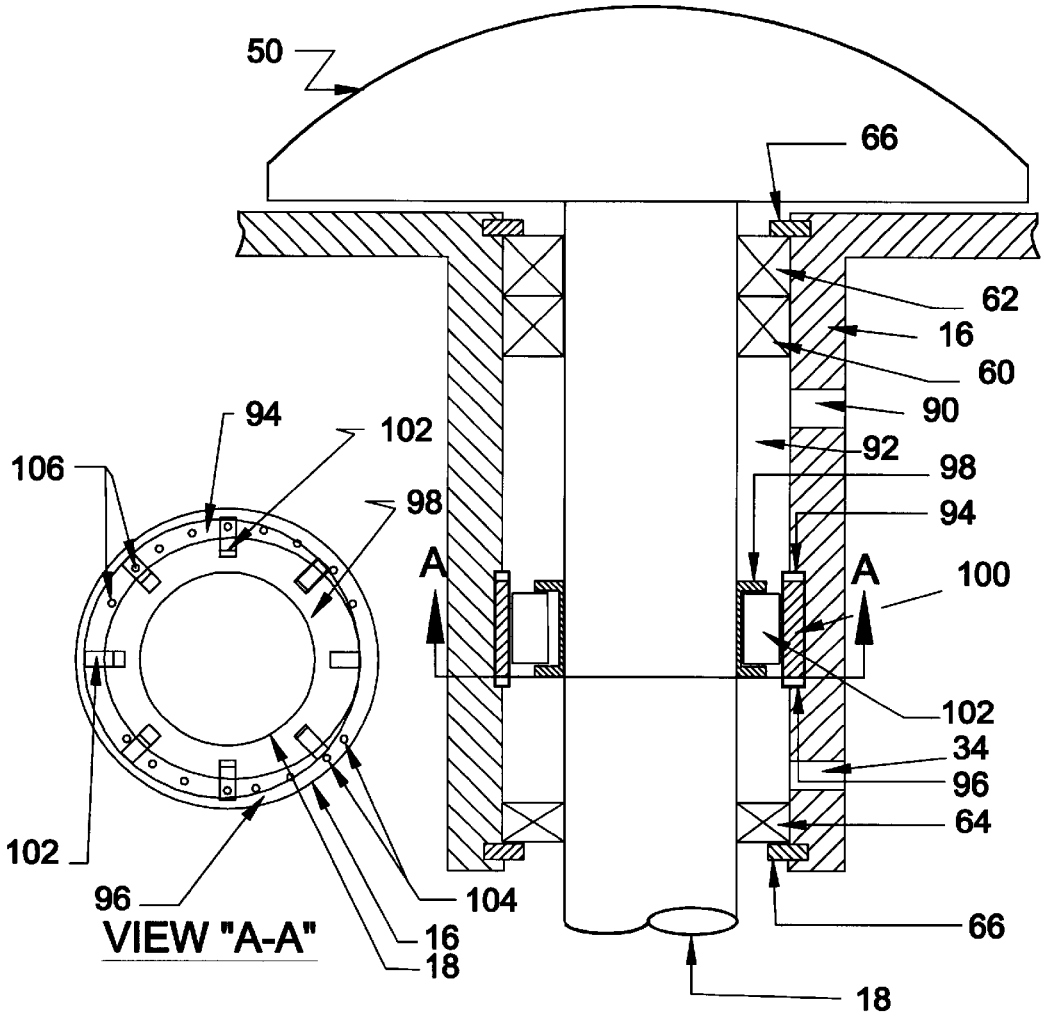
FIG. 8 is a schematic of a vane-type integrated axial flow pump having components integral to the shaft and components integral to the stuffing box.

In yet another embodiment, the integrated axial flow pump may be a type in which part of the pump is part of or mounted on the rotating shaft and part of the pump is part of or mounted on the inside of the stuffing box or on the inside of the housing if the pump is external to the stuffing box. In this embodiment, by non-limiting example, the pump may be a vane-type pump or a gear-in-gear type pump. A schematic of a typical vane-type integrated axial flow pump used in this way is shown in FIG. 8. Once again, the shaft [18], that turns the impeller [50] is encased in a stuffing box [16] through which the oil inlet [34] and an oil outlet [90] pass into a chamber [92] in which is mounted a vane pump that distributes the oil evenly around the shaft. The oil is sealed in place by packing or sealing rings [60], [62] and [64] that are held in turn held in place by stops [66], in this case snap rings, although they may also be held by a shoulder machined into the stuffing box or by other means. As usual, the design and the number of the spacer or spacers, and of the packing or sealing rings and stop or stops are adapted to the specific designs of the stuffing box.

The vane pump itself is shown in more detail (as seen at the cross-section indicated by View A—A) in FIG. 8. It consists essentially of end plates [94 and 96] and a rotor [98], around the shaft [18], inside an eccentric ring [100]. Movable vanes [102] are set into the rotor, and ports [104 and 106] pass through the end plates [94 and 96]. Although the vane pump can operate in either direction, assume here that the shaft, and therefore the rotor are rotating clockwise and that oil is being drawn into oil inlet [34] and passes out through oil outlet [90]. In that case, the ports on the bottom of the cross-section View A—A in FIG. 8 are oil inlet ports [104] in end plate [96], and the ports on the top of the cross-section View A—A in FIG. 8 are oil outlet ports [106] in end plate [94]. (In reality, the end plate [96], and the ports [104] are just touching the cross-section plane from the perspective at which the cross-section is being viewed, but they are shown in View A—A for the purposes of explanation; no single exact cross-section would actually show both end plates and both sets of ports.) In operation, as the rotor rotates within the eccentric ring, each vane moves in and out (relative to the shaft) depending upon the varying clearance at its location between the rotor and the eccentric ring. The vanes are moved out from the center of the shaft, for example, by springs (not shown) between the vanes and the rotor where the gap between the rotor and the eccentric ring increases, and are moved back where the gap between the rotor and the eccentric ring decreases. As the vanes move past the oil inlet ports, the gap between the rotor and the eccentric ring is increasing, the vanes are moving out and oil flows from the oil inlet, along the shaft, through the oil inlet ports, into the gap and is moved by the vanes. As the vanes move past the outlet ports, the gap between the rotor and the eccentric ring is decreasing, the vanes are moving out and oil flows from the gap and is moved by the vanes out the oil outlet ports, along the shaft, and out the oil outlet. This is a schematic only, and one skilled in the art could construct many different designs incorporating a vane pump that vary in detail without deviating from the scope and intent of the Invention.

What is claimed is:

1. An apparatus having a rotating shaft requiring a lubricating and cooling material to flow along the rotating shaft between the shaft and seals while the shaft is rotating comprising an integrated axial flow pump that moves said material from an external supply vessel into the stuffing box through an inlet between the seals, wherein said integrated axial flow pump comprises one or more straight blades mounted on the rotating shaft.

2. An apparatus having a rotating shaft requiring a lubricating and cooling material to flow along the rotating shaft between the shaft and seals while the shaft is rotating comprising an integrated axial flow pump that moves said material from an external supply vessel into the stuffing box through an inlet between the seals, wherein said integrated axial flow pump comprises one or more straight grooves set into the rotating shaft.

3. An apparatus having a rotating shaft requiring a lubricating and cooling material to flow along the rotating shaft between the shaft and seals while the shaft is rotating comprising an integrated axial flow pump that moves said material from an external supply vessel into the stuffing box through an inlet between the seals wherein said lubricating and cooling material is supplied from the supply vessel at ambient pressure.

4. An apparatus having a rotating shaft requiring a lubricating and cooling material to flow along the rotating shaft between the shaft and seals while the shaft is rotating comprising an integrated axial flow pump that moves said material from an external supply vessel into the stuffing box through an inlet between the seals wherein said integrated axial flow pump is external to the stuffing box, and the lubricating and cooling material passes from said integrated axial flow pump to an inlet between the seals in the stuffing box through a conduit.

5. A method of pumping cement into a wellbore penetrating a subterranean formation comprising pumping the cement with a centrifugal pump wherein the rotating shaft of the pump is cooled and lubricated by compelling cooling and lubricating material to flow along the axis of the rotating shaft between the shaft and seals from an external reservoir with an integrated axial flow pump.

* * * * *